United States Patent [19]

Fischer

[11] 4,324,435

[45] Apr. 13, 1982

[54] LOCK ASSEMBLY FOR EARTHWORKING APPARATUS

[75] Inventor: Robert L. Fischer, New Lenox, Ill.

[73] Assignee: Caterpillar Tractor Co., Peoria, Ill.

[21] Appl. No.: 245,229

[22] PCT Filed: May 8, 1980

[86] PCT No.: PCT/US80/00536

§ 371 Date: May 8, 1980

§ 102(e) Date: May 8, 1980

[51] Int. Cl.[3] ..... A01B 15/20

[52] U.S. Cl. ..... 299/37; 172/386; 172/445.2; 212/229; 292/201; 292/DIG. 40; 299/70; 173/39

[58] Field of Search ..... 299/37, 69, 70; 172/386, 445.2, 673; 188/69; 403/103; 212/229; 292/201, DIG. 40; 173/39, 43

[56] References Cited

U.S. PATENT DOCUMENTS

| | | | |
|---|---|---|---|
| 2,210,989 | 8/1940 | Sutherland | 292/DIG. 40 |
| 2,633,777 | 4/1953 | Hoern | 188/69 |
| 2,634,002 | 4/1953 | Paul | 212/229 X |
| 3,118,347 | 1/1964 | Thompson | 90/56 |
| 3,324,956 | 6/1967 | Ritchie | 172/386 |
| 3,346,281 | 10/1967 | Thompson | 287/58 |
| 3,436,120 | 4/1969 | Armstrong | 173/43 X |
| 3,450,213 | 6/1969 | Creighton et al. | 172/785 |
| 3,576,215 | 4/1971 | Cline | 172/445.2 |
| 3,648,956 | 3/1972 | Paulson et al. | 212/229 X |
| 3,868,145 | 2/1975 | Cobb et al. | 299/37 |
| 3,915,501 | 10/1975 | Cobb et al. | 299/67 |
| 3,972,378 | 8/1976 | Houriez et al. | 180/6.58 |
| 4,132,290 | 1/1979 | Dezelan et al. | 188/69 |

FOREIGN PATENT DOCUMENTS

| | | | |
|---|---|---|---|
| 2901923 | 2/1980 | Fed. Rep. of Germany | 212/229 |

*Primary Examiner*—Ernest R. Purser
*Attorney, Agent, or Firm*—Claude F. White

[57] ABSTRACT

A pivotal lock member (27) is secured to an earthworking apparatus (10) and a plurality of lock stations (28,29,30) are connected to a mounting assembly (21) which supports the earthworking apparatus (10) for rotation. The apparatus (10) can be rotated to a plurailty of angular positions and must be held against rotation in each position. The lock member (27) pivots in and out of engagement with the lock stations (28,29,30) to allow rotation or locking of the earthworking apparatus (10). The lock assembly (26) holds the earthworking apparatus (10) securely against rotary motion but allows some limited radial motion of the apparatus in a plane co-incident with a line of axial force generated by the operation of the earthworking tool (19).

12 Claims, 3 Drawing Figures

LOCK ASSEMBLY FOR EARTHWORKING APPARATUS

DESCRIPTION

Technical Field

This invention relates generally to a lock assembly and more paticularly to a locking assembly for locking a rotatable earthworking apparatus to a mounting bracket to prevent the earthworking apparatus from rotating.

Background Art

Earthworking apparatus, such as rockbreakers and impact rippers are used to fracture rock and rip trenches in the earth. Such earthworking apparatus is normally mounted on a mobil earthworking machine and the machine travels along the ground while the earthworking apparatus performs its trenching or ripping operation. The earthworking apparatus is normally mounted upon the machine in such a manner that it can be rotated to various angular positions relative to the axial path of the machine.

Once the earthworking apparatus has been rotated to a particular angular position, it must be securely held in that position while the apparatus performs its work function. The securing means are subjected to extremely high loads and continual cycling of the loads.

One type of securing means previously used consisted of a pair of hydraulic cylinders which rotated the earthworking apparatus to the angular position and then attempted to hold the apparatus from rotating by providing an hydraulic lock within the cylinders. The high shock loading and cyclic action of the earthworking apparatus caused the hydraulic cylinders to become damaged in a short period of time.

Other attempts at solving the locking problem included the use of a locking pin inserted into a hole in a plate. However, the high axial loads exerted by the earthworking apparatus soon damaged the bearing surface in the plate and allowed the lock pin to move.

These previous locking systems were inadequate, in part, because they did not allow any freedom of movement in a radial direction in line with the line of force of the work tool. Such freedom of movement is desirable so the locking mechanisms do not need to absorb the high loads generated by the earthworking apparatus.

The present invention is direced to overcoming one or more of the problems as set forth above.

Disclosure of the Invention

In one aspect of the present invention, a movable lock member securely locks a rotatable earthworking apparatus to a non-rotatable mounting assembly to prevent rotation of the apparatus while still allowing limited radial motion. The present invention also provides a plurality of lock stations, and means to move the lock member in and out of engagement with any of the lock stations, so as to locate the earthworking apparatus at various angular working positions.

BEST MODE FOR CARRYING OUT THE INVENTION

Figure 1:
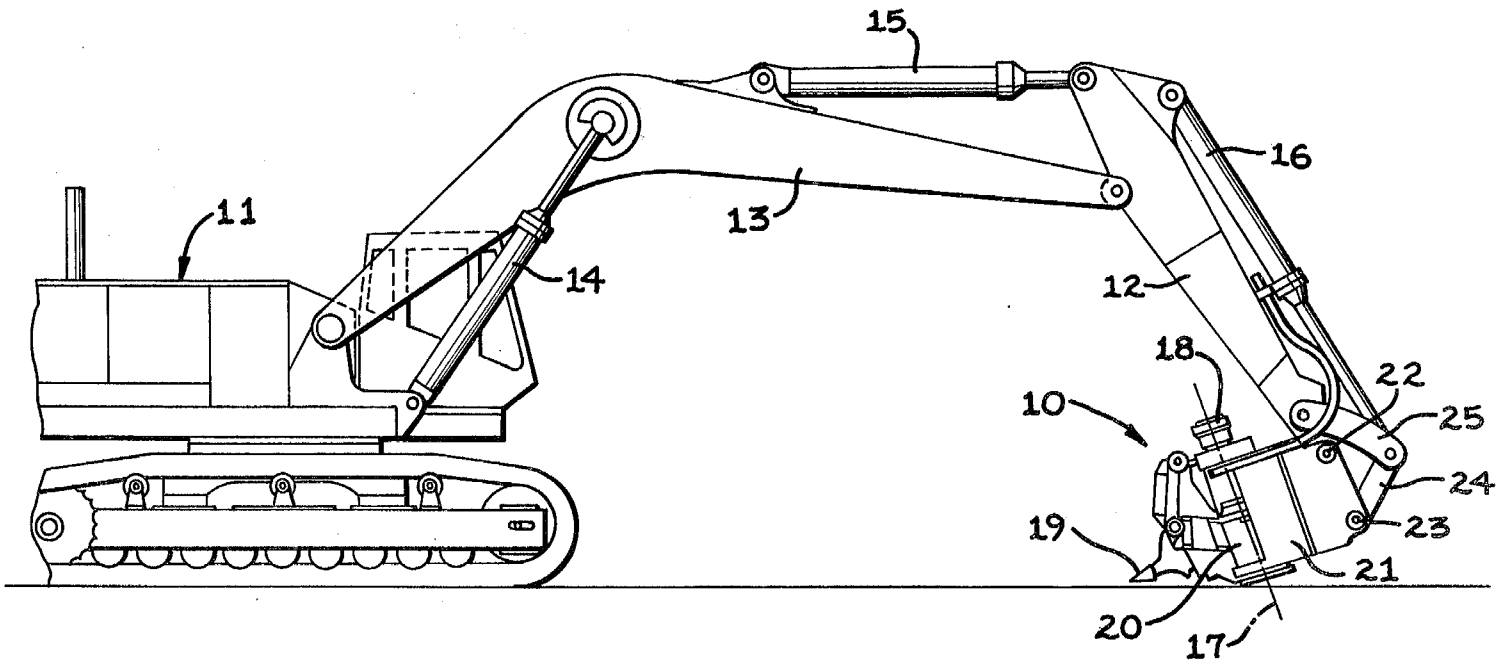
FIG. 1 is a side elevational view of an embodiment of the present invention illustrated in connection with a material fracturing apparatus shown mounted on a mobile earthmoving machine.

Referring to FIG. 1 of the drawings, a material fracturing apparatus 10 is mounted upon a mobil earthworking machine 11 by means of an arm 12 and a boom 13. The fracturing apparatus 10 can be manipulated by fluid cylinder 14, which moves the boom 13, by fluid cylinder 15, which moves the arm 12, or by fluid cylinder 16, which moves the fracturing apparatus itself.

In addition to the above-noted manipulations, the fracturing apparatus 10 can be rotated from side to side, relative to the plane of the FIG. 1 drawing, about axis 17. The fracturing apparatus includes an energy source, such as fluid motor 18 and associated flywheels (not shown), for activating an earthworking tool or ripper tip 19. Such material fracturing apparatus is known in the art and is exemplified by U.S. Pat. No. 3,868,145 and U.S. Pat. No. 3,915,501, both assigned to the assignee of the subject application.

The fracturing apparatus 10 further includes a rotatable housing 20 which is mounted for rotation on a mounting bracket assembly 21. Mounting assembly 21 is secured to arm member 12 by appropriate manipulating means, such as pivot pins 22 and 23 and links 24 and 25.

Apparatus 10 is rotated relative to mounting assembly 21 by power means (not shown, such as fluid motors or by manipulating the arm 12, boom 13, machine 11, or combinations thereof.

Figure 2:
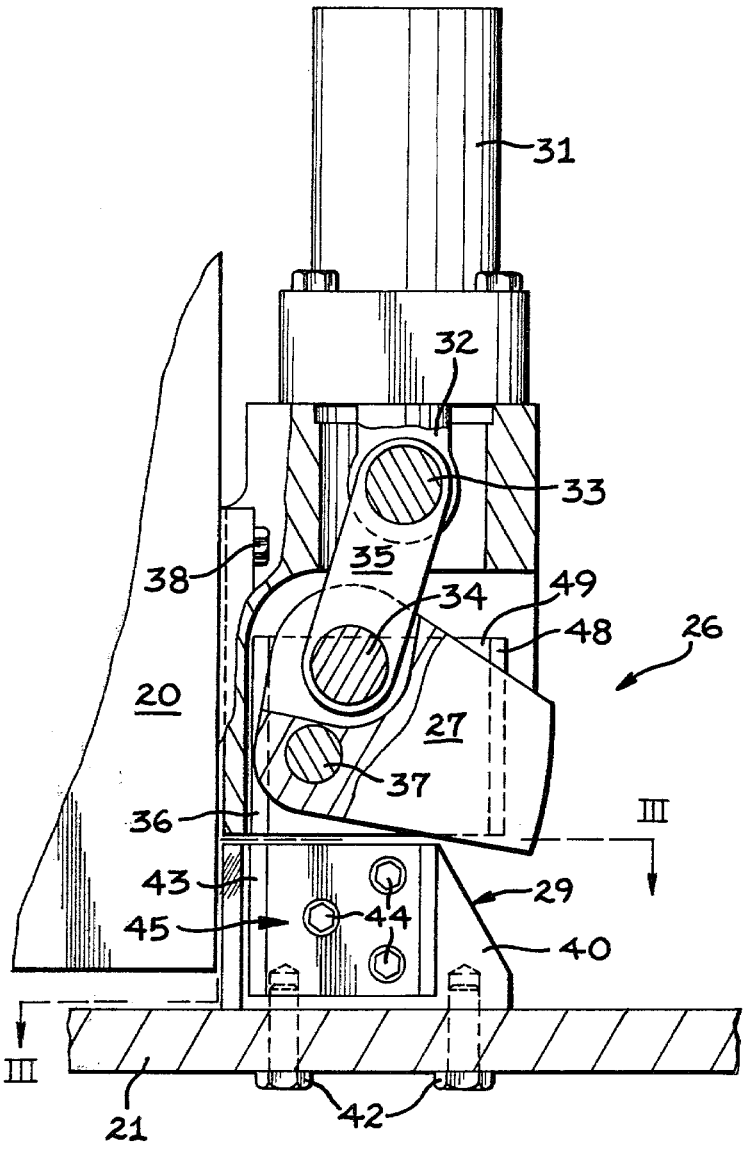
FIG. 2 is a somewhat enlarged side elevational view, partly in section of the subject invention.
Figure 3:
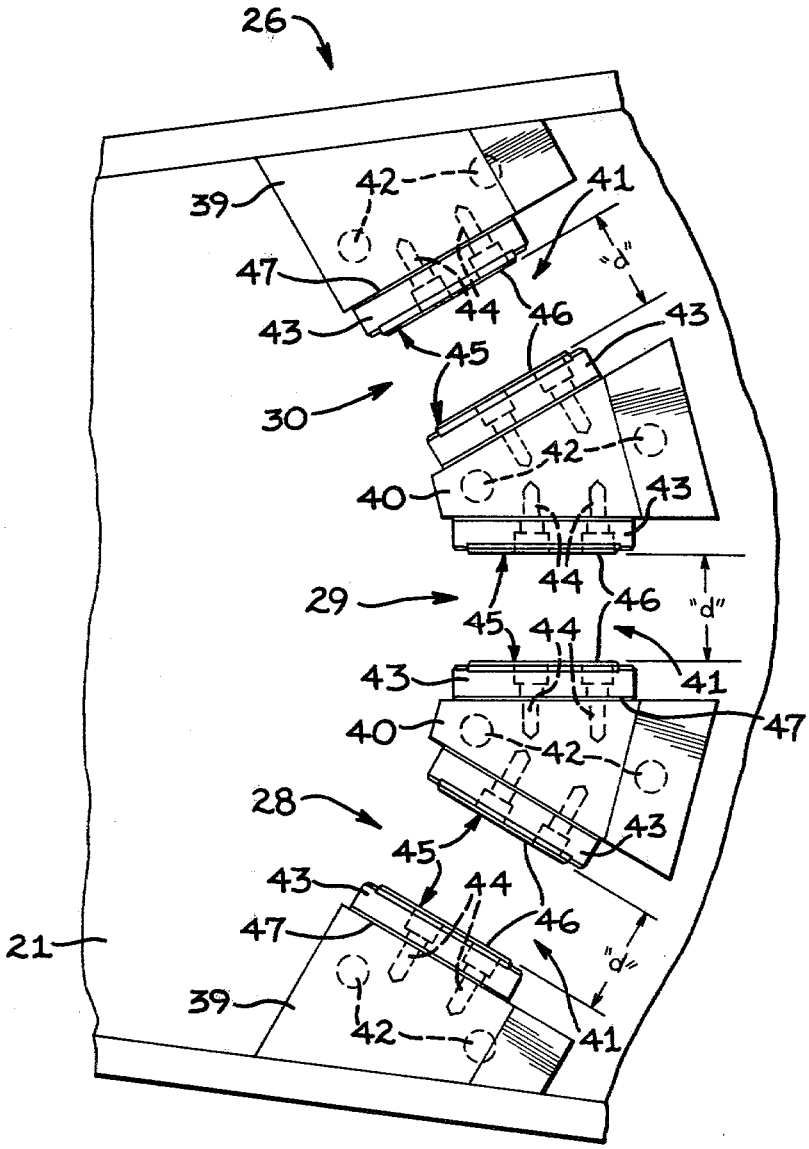
FIG. 3 is a plan view of the subject invention looking in the direction of the arrows on line III—III of FIG. 2.

Referring to FIGS. 2 and 3 of the drawings, a lock assembly 26, embodying the principles of the present invention, is shown including a pivotal lock member 27 and a plurality of lock stations 28, 29, and 30. A power source, such as fluid motor 31, is provided for moving lock member 27 in and out of locking engagement with the lock stations. Lock member 27 is fastened to a piston rod 32 of fluid motor 31 by means of pins 33 and 34 and links 35, only one being shown in FIG. 2. Lock member 27 is also secured for pivotal vertical movement to a bracket 36 by pin 37. Bracket 36 is secured to rotatable housing 20 by a plurality of fastening means, such as bolts 38.

Each lock station 28, 29, and 30 includes first and second locking blocks 39,40 and an opening 41 therebetween. As is evident from FIG. 3, two of the locking blocks 39,40 comprise a portion of at least two of the lock stations 28, 29, and 30. The locking blocks are secured in any convenient manner, such as bolts 42, to the mounting assembly 21.

A replaceable contact plate 43 is secured, as by bolts 44, to each locking block 39,40. The central two locking blocks 39,40 have a contact plate 43 on each side of the block. Each plate 43 has a contact surface 45 for contacting the lock member 27 when in a locked position. The contact surface 45 preferably comprises a replaceable non-metalic insert 46, which can be teflon, nylon, or other similar material. By using this type of non-metal contact surface, the lock member 27 can be locked and unlocked many times with little wear on the lock member or the inserts 46. Also, friction between the lock member and inserts is reduced during the locking and unlocking cycles and the inserts provide some cushioning to impact.

In view of the low friction between the lock member 27 and the inserts 46, the dimension "d" of opening 41 can be very close to the thickness of the lock member. The dimension "d" can be varied to accommodate for manufacturing tolerances of the various components, and to compensate for any wear, by adding one or more spacers or shims 47 to one or more of the locking blocks 39,40. Preferably, the spacers are located between the blocks 39,40 and the contact plates 43 and are held in place by bolts 44.

As can be seen in FIG. 2, situated on each side of the lock member 27, and secured to the bracket 36 are additional contact plates 48. Contact plates 48 are similar to contact plates 43 and serve the same purpose, that is, to closely position the lock member 27 and provide low friction during movement of lock member 27. To this end, replaceable non-metalic inserts 49, similar to inserts 46 are provided on the contact surfaces of plates 48. The non-metalic inserts 49 also provide some resiliency and cushioning to impact for the lock assembly.

Industrial Applicability

The subject lock assembly 26 is particularly useful for locking a rotatable material fracturing apparatus 10 to a mounting plate assembly 21 to prevent the apparatus 10 from rotating during a work cycle.

The material fracturing apparatus 10 is particular suited for digging trenches or fracturing rock while mounted for manipulations on an earthmoving machine 11. One such manipulation is the rotating, from side to side, of the material fracturing apparatus in order to dig a wide trench or to clean the corners of a trench.

In order to rotate the apparatus 10, fluid motor 31 is activated to retract piston rod 32. This pivots locking member 27 about pin 37 and unlocks member 27 from locking engagement with locking station 28, 29, or 30. The machine 11 then rotates the earthworking apparatus to the desired angular position. Fluid motor 31 is then activated to extend piston rod 32, which again pivots locking member 27 about pin 37 to position member 27 in one of the locking stations 28, 29, or 30.

When the material fracturing apparatus 10 has been properly locked in the desired locking station, the work operation, consisting or ripping, trenching, etc. can continue. During the work operation, a large axial force is generated by the action of the earthworking tool 19. This axial force is transferred into the apparatus 10 and causes the apparatus to move radially with respect to the axis of rotation 17. Although the lock assembly 26 holds the apparatus securely against rotary motion, it allows limited radial motion in line with the axial force of tool 19. This is possible because of the opening 41 between each pair of locking blocks. Such limited radial motion is desirable to prevent the locking mechanism from absorbing the large axial loads generated by the earthworking apparatus.

Other aspect, objects and advantages of this invention can be obtained from a study of the drawings, the disclosure, and the appended claims.

I claim:

1. In an earthworking apparatus (10) having an energy source (18) for activating an earthworking tool (19), a rotatable housing (20) for enclosing said energy source (18), a mounting assembly (21) for rotatably supporting said housing (20), and means for rotating said housing (20) relative to said mounting assembly (21), the improvement comprising:

a moveable lock member (27) mounted on said housing (20);

means (26) for locking said housing (20) to said mounting assembly (21) and preventing rotational motion, said means including a plurality of lock stations (28,39,30) disposed on said mounting assembly (21), each block station (28, 29, 30) including first and second separate blocks (39, 40), said blocks (39, 40) each being connected to said mounting assembly (21) and spaced a preselected distance ("d") one from the other and defining an opening (41) having a longitudinal axis and being of a preselected size ("d"), said opening size ("d") being adapted to receive said lock member (27) for unrestrained movement of the lock member (27) along the longitudinal axis of the opening (41) and restrain movement of the lock member (27) in directions transverse to said longitudinal axis in the activation position of said earthworking tool; and means (31) for moving said lock member (27) in and out of locking engagement with said lock stations (28,29,30).

2. The earthworking apparatus (10) as set forth in claim 1 wherein said means (31) for moving said lock member includes a plurality of pins (33,34,37) and links (35) and a fluid motor (31).

3. The earthworking apparatus (10) as set forth in claim 1 wherein at least two of said first or second locking blocks (39,40) comprise a portion of at least two of said lock stations (28,29,30).

4. The earthworking apparatus (10) as set forth in claim 1 including spacer means (47) secured to at least one of said first or second locking blocks (39,40) to vary the dimension (d) of said opening (41).

5. The earthworking apparatus (10) as set forth in claim 1 including non-metalic surfaces (45) on each of said locking blocks (39,40), said surfaces (45) comprising the contact surfaces (45) between said locking blocks (39,40) and said lock member (27).

6. The earthworking apparatus (10) as set forth in claim 5 wherein said non-metalic surfaces (45) comprise replaceable plastic inserts (46).

7. A locking mechanism (26) for securing a first member (20) to a second member (21), one of said first and second members (20,21) having an axis of rotation (17) and the other of said first and second members (20,21) being pivotally connected to said one member about said axis (17) comprising:

a movable lock member (27) secured to one of said first and second members (20,21);

a plurality of lock stations (28,29,30) disposed on the other of said first and second members (20,21), each lock station (28, 29, 30) including first and second separate blocks (39, 40), said blocks each being connected to the other of said first and second members (20, 21) and spaced a preselected distance ("d") one from the other and defining an opening (41) having a longitudinal axis and being of a preselected size ("d"), said opening size ("d") being adapted to receive said lock member (27) for unrestricted movement of the lock member (27) along the longitudinal axis of the opening (41) and restrain movement of the lock member (27) in directions transverse to said longitudinal axis; and means (31) for moving said lock member (27) in and out of engagement with said lock stations (28,29,30) for holding one of said first and second members (20,21) against rotation.

8. The locking mechanism (26), as set forth in claim 7, wherein at least two of said first or second locking blocks (39,40) comprise a portion of at least two of said lock stations (28,29,30).

9. The locking mechanism (26), as set forth in claim 7, including spacer means (47) secured to at least one of said first or second locking blocks (39,40) to vary the dimension (d) of said opening (41).

10. The locking mechanism (10), as set forth in claim 7, wherein each of said first and second locking blocks (39,40) includes a contact surface (45) and each contact surface (45) comprises a replaceable non-metalic insert (46).

11. The locking mechanism (26), as set forth in claim 7, including link means (35) and a plurality of pins (34,35) interconnecting said movable lock member (27) and said power means (31).

12. The locking mechanism (26), as set forth in claim 7, wherein said means (31) comprises a fluid motor (31).

* * * * *